US008654052B2

(12) United States Patent
Lee et al.

(10) Patent No.: US 8,654,052 B2
(45) Date of Patent: Feb. 18, 2014

(54) METHOD AND DEVICE FOR DRIVING LOCAL DIMMING IN LIQUID CRYSTAL DISPLAY DEVICE

(75) Inventors: Jung-Hwan Lee, Paju-si (KR); Kyung-Joon Kwon, Seoul (KR); Dong-Woo Kim, Seoul (KR); Hee-Won Ahn, Goyang-si (KR)

(73) Assignee: LG Display Co., Ltd., Seoul (KR)

( * ) Notice: Subject to any disclaimer, the term of this patent is extended or adjusted under 35 U.S.C. 154(b) by 226 days.

(21) Appl. No.: 13/177,964

(22) Filed: Jul. 7, 2011

(65) Prior Publication Data

US 2012/0056907 A1 Mar. 8, 2012

(30) Foreign Application Priority Data

Jul. 9, 2010 (KR) ..... 10-2010-0066624

(51) Int. Cl.
*G09G 3/36* (2006.01)

(52) U.S. Cl.
USPC ..... 345/89; 345/690

(58) Field of Classification Search
USPC ..... 345/87–104, 690–693
See application file for complete search history.

(56) References Cited

U.S. PATENT DOCUMENTS

2009/0295705 A1 12/2009 Chen et al.
2010/0020094 A1 1/2010 Park et al.

FOREIGN PATENT DOCUMENTS

CN 101640022 A 2/2010

OTHER PUBLICATIONS

Office Action issued in corresponding Chinese Patent Application No. 201110189578.2, mailed Nov. 16, 2012.
Search Report issued in corresponding Chinese Patent Application No. 201110189578.2, dated Nov. 8, 2012.

*Primary Examiner* — Chanh Nguyen
*Assistant Examiner* — Sanghyuk Park
(74) *Attorney, Agent, or Firm* — Brinks, Gilson & Lione

(57) ABSTRACT

The present invention provides method and device for driving local dimming in a liquid crystal display device which enables adaptive application of a gradation roll-off according to an image characteristic. The method for driving local dimming in a liquid crystal display device includes the steps of determining a local dimming value of each light emitting block by analyzing a received image data light emitting block by light emitting block of a backlight unit, producing a pixel compensating coefficient on a light quantity change of each pixel by using the local dimming value of each light emitting block, producing a required gradient value by compensating the received image data by using the pixel compensating coefficient, and producing maximum required gradient values for one frame and an average value of the maximum required gradient values for one frame, determining a roll-off end point of a gradient roll-off section according to the maximum required gradient value, and determining a roll-off starting point of the gradient roll-off section according to the average of the maximum required gradient values, setting a gradient change curve of the gradient roll-off section by using the roll-off starting point and end point, and producing a gain value of each pixel from the gradient change curve, and forwarding an output gradient value by correcting the required gradient value by using the gain value of each pixel.

9 Claims, 10 Drawing Sheets

Curved line type

Broken line type

Original image

Pixel compensation without roll-off

Conventional roll-off

Adaptive roll-off

METHOD AND DEVICE FOR DRIVING LOCAL DIMMING IN LIQUID CRYSTAL DISPLAY DEVICE

Pursuant to 35 U.S.C. §119(a), this application claims the benefit of earlier filing date and right of priority to Korean Application 10-2010-0066624, filed on Jul. 9, 2010, the content of which is incorporated by reference herein in its entirety.

BACKGROUND

1. Field of the Invention

The present disclosure relates to liquid crystal display devices, and more particularly to method and device for driving local dimming in a liquid crystal display device, which can suppress brightness drop while moderating gradation concentration caused by data compensation at the time of local dimming.

2. Discussion of the Related Art

Currently, as image display devices, flat display devices, such as liquid crystal display device LCD, plasma display panel PDP, and organic light emitting diode OLED display device, are used, mostly.

The liquid crystal display device is provided with a liquid crystal panel which displays an image with a pixel matrix which uses electric and optical characteristics of liquid crystals having anisotropy in refractive index and dielectric, a driving circuit for driving the liquid crystal panel, and a backlight unit for directing a light to the liquid crystal panel. Each of pixels of the liquid crystal display device produces gradation by controlling transmissivity of a light transmitting the liquid crystal panel and a polarizing plate from the backlight unit by varying orientation of the liquid crystals in response to a data signal.

In the liquid crystal display device, brightness of each of the pixels is the multiplication of brightness of the backlight unit to the light transmissivity of the liquid crystals in response to a data signal. In order to improve a contrast ratio and reduce power consumption, the liquid crystal display device uses backlight dimming in which a received image is analyzed to adjust a dimming value for controlling backlight brightness and compensating data. For an example, the backlight unit dimming method for reducing the power consumption reduces the backlight unit brightness by reducing the dimming value and improves the brightness by compensating the data.

Currently, as the backlight unit, an LED backlight unit is used, which uses light emitting diodes LED having advantages of high brightness and low power consumption compared to a related art lamp. Since the LED backlight unit enables local brightness control, the LED backlight unit can be driven by a local dimming method in which the LED backlight unit is divided into a plurality of light emitting blocks for controlling the brightness block by block. In the local dimming, an image data is analyzed block by block to determine a local dimming value, and controls the brightness of the LED backlight unit block by block as well as compensates the image data block by block, to improve the contrast ratio further and to reduce the power consumption more.

However, though the local dimming compensates the brightness by increasing the data as much as reduced brightness of the backlight unit by the local dimming, since there is a limit in data increase, resulting to compensate all of the pixels in a high gradation (bright) region with the same threshold value, the local dimming has a problem of occurrence of gradation concentration.

In order to moderate the gradation concentration, a gradation roll-off method has been suggested, in which the data in the high gradation region is adjusted to be dark throughout the region. However, since the related art gradation roll-off method is always applied to the high gradation region regardless of an image characteristic, though the related art gradation roll-off method has an advantage of increasing a range of displayable gradation values in an image which has much gradation concentration, the related art gradation roll-off method has a drawback of drop of the brightness in an image which has no gradation concentration.

BRIEF SUMMARY

A method for driving local dimming in a liquid crystal display device includes the steps of determining a local dimming value of each light emitting block by analyzing a received image data block by block of a backlight unit, calculating a pixel compensating coefficient on a light quantity change of each pixel by using the local dimming value of each light emitting block, calculating a required gradient value by compensating the received image data by using the pixel compensating coefficient, and calculating maximum required gradient values for one frame and an average value of the maximum required gradient values for one frame, determining a roll-off end point of a gradient roll-off section according to the maximum required gradient value, and determining a roll-off starting point of the gradient roll-off section according to the average of the maximum required gradient values, setting a gradient change curve of the gradient roll-off section by using the roll-off starting point and end point, and producing a gain value of each pixel from the gradient change curve, and forwarding an output gradient value by correcting the required gradient value by using the gain value of each pixel.

In another aspect of the present invention, a device for driving local dimming in a liquid crystal display device includes an image analyzing unit for detecting a representative value of each light emitting block by analyzing a received image data block by block of a backlight unit, a dimming value producing unit for determining and producing a local dimming value of each light emitting block according to the representative value of each block, and a data compensating unit for calculating a pixel compensating coefficient on a light quantity change of each pixel by using the local dimming value of each block, calculating a required gradient value by compensating the received image data by using the pixel compensating coefficient, calculating maximum required gradient values for one frame and an average value of the maximum required gradient values for one frame, determining a roll-off end point of a gradient roll-off section according to the maximum required gradient value, determining a roll-off starting point of the gradient roll-off section according to the average of the maximum required gradient values, producing a gain value of each pixel from a gradient change curve of the gradient roll-off section set by using the roll-off starting point and end point, and forwarding an output gradient value by correcting the required gradient value by using the gain value of each pixel.

It is to be understood that both the foregoing general description and the following detailed description of the present invention are exemplary and explanatory and are intended to provide further explanation of the invention as claimed.

BRIEF DESCRIPTION OF THE DRAWINGS

The accompanying drawings, which are included to provide a further understanding of the disclosure and are incorporated in and constitute a part of this application, illustrate embodiment(s) of the disclosure and together with the description serve to explain the principle of the disclosure. In the drawings:

FIGS. 5A~5C illustrate another forms of gradient change curves applicable to adaptive gradient roll-off in accordance with an embodiment of the present invention, respectively.

DETAILED DESCRIPTION OF THE DRAWINGS AND THE PRESENTLY PREFERRED EMBODIMENTS

Before describing an embodiment of the present invention, gradient roll-off related to local dimming of the present invention will be described in more detail.

Figure 1A:
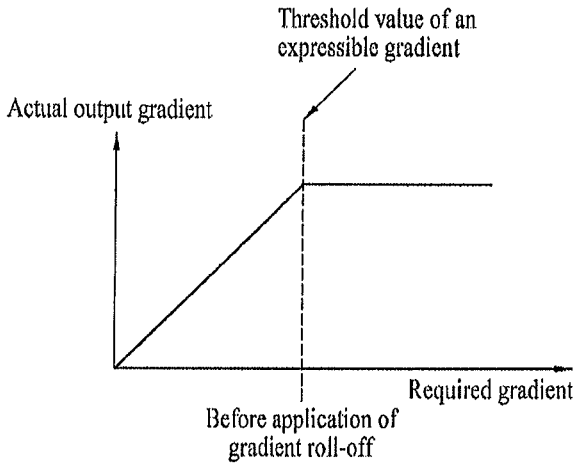
FIGS. 1A and 1B illustrate gradient change curves before and after application of gradient roll-off thereto, respectively.
Figure 1B:
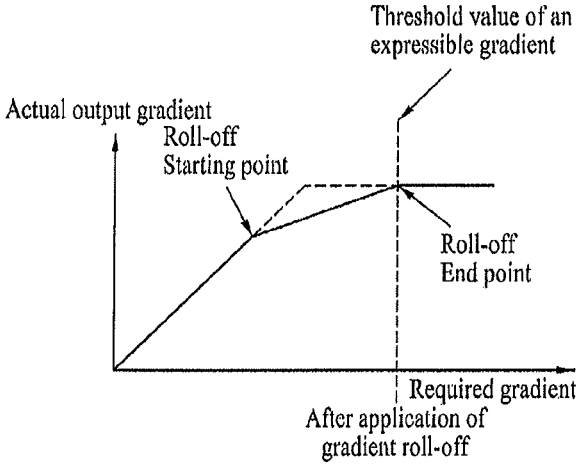

The gradient roll-off related to local dimming of the present invention reduces a data at a high gradient region for moderating gradient concentration caused by data compensation. A range of required gradient produced by the data compensation in the local dimming is greater than a range of an actually expressible gradient, i.e., an actual output gradient of the liquid crystal display device. Therefore, as shown in the gradient change curve in FIG. 1A, since a threshold value of the expressible gradient is small, to map all of a relatively large amount of required gradients greater than the threshold value on the same maximum output gradient (for an example, 255) and saturate the same, the gradient concentration becomes intensive. Opposite to this, after the roll-off is applied, as shown in the gradient change curve in FIG. 1B, as a slope of a second straight line curve in a section the roll-off is applied thereto is reduced in comparison to a slope of a first straight line curve in a section the roll-off is not applied thereto, to increase a threshold value of the expressible gradient, a range of the gradient expressible as the actual output gradient can be increased in the required gradient. Accordingly, as the range of the required gradient to be mapped on the maximum output gradient is reduced, to reduce a number of the pixels at which the gradient is saturated, the concentration of the gradient is reduced. However, if a starting point and an end point of the roll-off are fixed in FIG. 1B regardless of whether there is the gradient concentration or not and an extent of the gradient concentration in an image, brightness is reduced in an image which has no gradient concentration.

In order solve this problem, the local dimming of the present invention applies adaptive roll-off which enables adaptive adjustment of a starting point and an end point of the roll-off according to occurrence of the gradient concentration and the extent of the gradient concentration of an image, for moderating the gradient concentration in an image having many gradient concentration and suppressing brightness drop in an image having small gradient concentration.

Reference will now be made in detail to the specific embodiments of the present invention, examples of which are illustrated in the accompanying drawings. Wherever possible, the same reference numbers will be used throughout the drawings to refer to the same or like parts.

Figure 2:
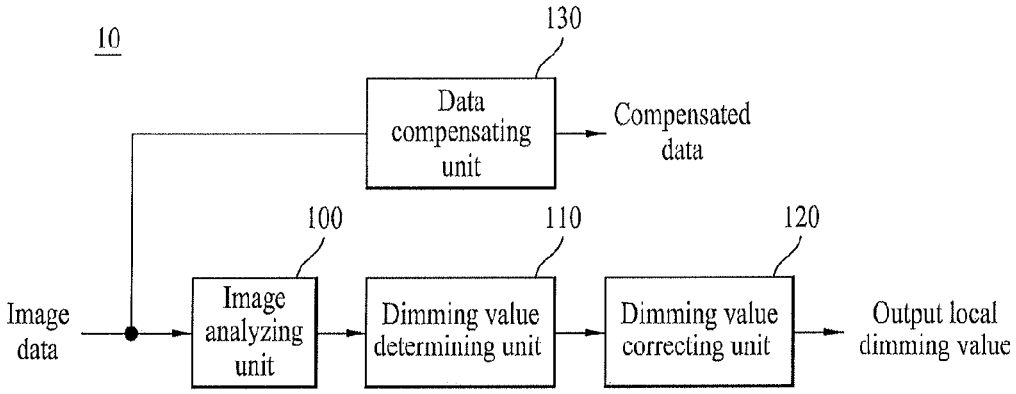
FIG. 2 illustrates a block diagram of a circuit of a local dimming driver in a liquid crystal display device in accordance with an embodiment of the present invention.

FIG. 2 illustrates a block diagram of a circuit of a local dimming driver in a liquid crystal display device in accordance with a preferred embodiment of the present invention.

Referring to FIG. 2, the local dimming driver 10 includes an image analyzing unit 100, a dimming value determining unit 110, a dimming value correcting unit 120, and a data compensating unit 130.

The image analyzing unit 100 receives and analyzes a received image data on each light emitting block of an LED backlight unit, detects an average value on each light emitting block, and forwards to the same to the dimming value determining unit 110. For an example, the image analyzing unit 100 detects a maximum value of each pixel from the received image data, sums and averages the maximum values of the pixels on each block to detect a data average value of each block, and forwards the same to the dimming value determining unit 110.

The dimming value determining unit 110 determines a local dimming value of each block matched to the average value of each block received from the image analyzing unit 100, and forwards the same to the dimming value correcting unit 120 and the data compensating unit 130. For an example, the dimming value determining unit 110 selects the local dimming value of each block matched to the average value of each block with reference to a look up table preset and stored by a designer.

The dimming value correcting unit 120 corrects the local dimming value of each block from the dimming value determining unit 110 with spatial filtering to moderate a dimming difference between the blocks and forwards the same to the backlight driver. For an example, the dimming value correcting unit 120 can reduce a dimming difference between the light emitting blocks by giving a weighted value to the local dimming value of a peripheral light emitting block positioned at a periphery of each light emitting block and applies the same to the local dimming value of the light emitting block, and the dimming difference can be reduced further by repeating the spatial filtering. And, the dimming value correcting unit 120 can correct the local dimming value corrected thus further by applying a global dimming value received from an outside of the backlight unit owing to user's brightness adjustment and forward the same.

The data compensating unit 130 calculates a pixel compensating coefficient on a light quantity change of each pixel by using the local dimming value of each block from the dimming value determining unit 110, and compensates data by using the pixel compensating coefficient calculated thus, to produce the required gradient value. And, the data compensating unit 130 determines application of gradient roll-off adaptively by using a maximum required gradient value of the required gradient values of one frame. And, the data compensating unit 130 determines an end point of the gradient roll-off by using the maximum required gradient value, and a starting point of the gradient roll-off by using an average value of the required gradient values of one frame, to determine a gradient change curve in a gradient roll-off section. The data compensating unit 130 calculates a gain value of each pixel by using the gradient change curve determined thus, corrects the required gradient value by using the gain value of each pixel, i.e., rolls off, and forwards the same as an output gradient value.

Figure 3:
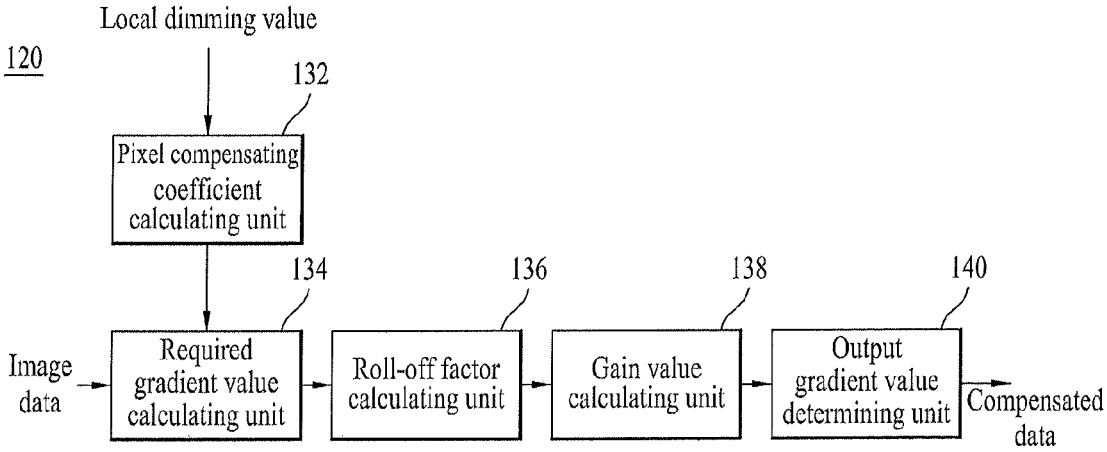
FIG. 3 illustrates a block diagram of a circuit of the data compensating unit in FIG. 2.

FIG. 3 illustrates a block diagram of a circuit of the data compensating unit 130 in FIG. 2, in detail.

Referring to FIG. 3, the data compensating unit 130 includes a pixel compensating coefficient calculating unit 132, a required gradient value calculating unit 134, a roll-off factor calculating unit 136, a gain value calculating unit 138, and an output gradient value determining unit 140.

The pixel compensating coefficient calculating unit 132 calculates a pixel compensating coefficient of each pixel on a light quantity change caused by the local dimming by using the local dimming value and a preset light profile of each light emitting block and forwards the same. For an example, the pixel compensating coefficient calculating unit 132 calculates a first total light quantity of each pixel which is a total quantity of lights reaching thereto from the plurality of light emitting blocks at the time the backlight unit is at a maximum brightness on the whole by using the light profile which is a light emitting characteristic of each light emitting block of the backlight unit, i.e., light quantities with respect to distances measured, digitized and stored in advance. The pixel compensating coefficient calculating unit 132 calculates a second total light quantity of each pixel which is a total quantity of lights reaching thereto from each light emitting block of which brightness is adjusted thus by the local dimming. The pixel compensating coefficient calculating unit 132 calculates a pixel compensating coefficient with a ratio of the second total light quantity to the first total light quantity and forwards the same to the required gradient value calculating unit 134.

The required gradient value calculating unit 134 calculates the required gradient value by compensating a received data by multiplying the pixel compensating coefficient from the pixel compensating coefficient calculating unit 132 to the received data (the gradient value). And, the required gradient value calculating unit 134 selects a maximum required gradient value from the required gradient values calculated on each frame and forwards the same to the roll-off factor calculating unit 136 as well as calculates an average value of the required gradient values of each frame and forwards the same to the roll-off factor calculating unit 136.

In this instance, in order to prevent flicker caused by sharp change or noise from taking place, as the maximum required gradient value and the average value of the required gradient value from the required gradient value calculating unit 134, the required gradient value calculating unit 134 can average the maximum required gradient values and the required gradient values of adjacent frames having weighted values given thereto by using a temporal filter for a plurality of frames, and can forwards the same to the roll-off factor calculating unit 136. An IIR (Infinite Impulse Response) filter can be used as the temporal filter.

The roll-off factor calculating unit 136 determines application roll-off by using the maximum gradient value of one frame from the required gradient value calculating unit 134, or determines the roll-off end point and the roll-off starting point by using the average value of the required gradient values of one frame, and forwards the same to the gain value calculating unit 138.

Figure 4A:
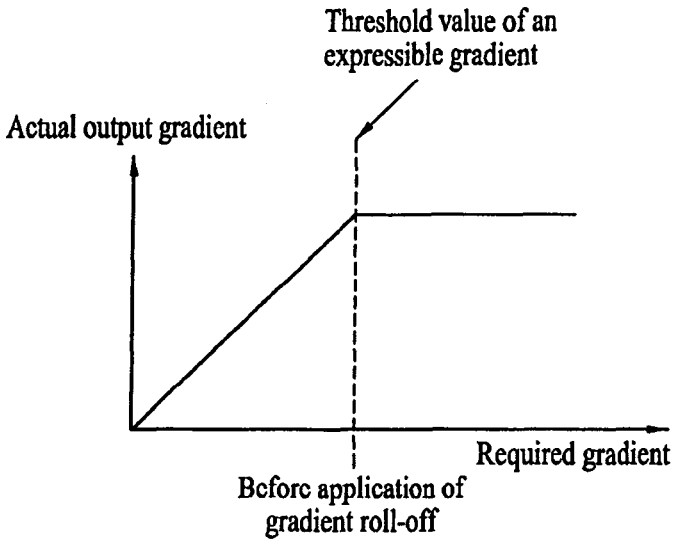
FIGS. 4A~4D illustrate gradient change curves applicable to adaptive gradient roll-off in accordance with an embodiment of the present invention, respectively.
Figure 4B:
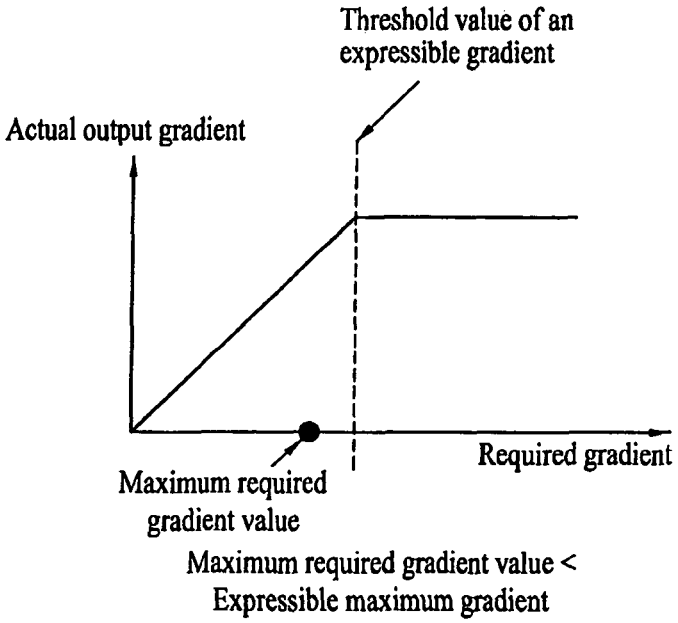

In detail, referring to FIG. 4B, since no roll-off is required in a case the maximum required gradient value is smaller than the expressible maximum gradient value, i.e., the maximum threshold value of the expressible gradient, the roll-off factor calculating unit 136 determines the roll-off starting point and end point to be the same point. For an example, if the threshold value of the expressible gradient is 255 if it is an 8 bit data, and 1023 if it is a 10 bit data.

Figure 4C:
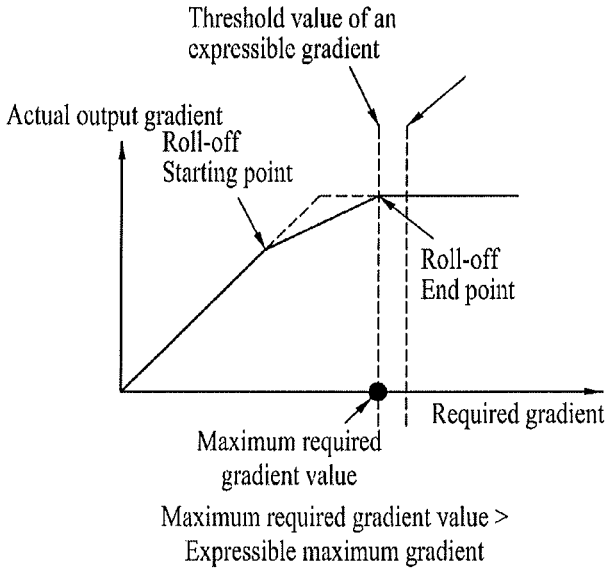
Figure 4D:
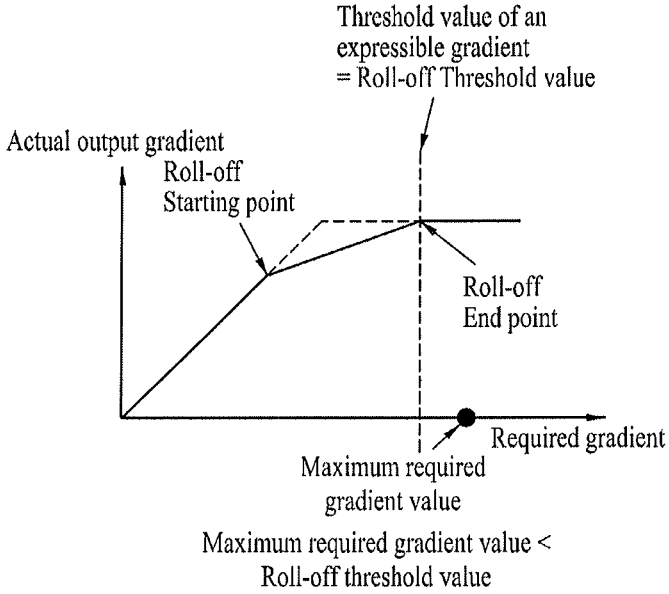

Referring to FIGS. 4C and 4D, if the maximum required gradient value is higher than the maximum threshold value of the expressible gradient, the roll-off end point is elevated up to a level at which the gradient concentration does not take place according to the maximum required gradient value. It is possible to prevent the brightness from dropping to much by the designer to set the roll-off maximum threshold value which the roll-off end point can have in advance experimentally. In this case, the roll-off end point is a greater value of the maximum required gradient value and the roll-off maximum threshold value. In other words, as shown in FIG. 4C, if the maximum required gradient value is higher than the maximum threshold value of the expressible gradient, and lower than the maximum threshold value of roll-off, the maximum required gradient value is determined as the roll-off end point. Opposite to this, as shown in FIG. 4D, if the maximum required gradient value is higher than the maximum threshold value of the expressible gradient and the maximum threshold value of roll-off, the maximum threshold value of roll-off is determined as the roll-off end point.

Moreover, the roll-off starting point is determined as the greater value of the average of the required gradient values of one frame and a roll-off minimum threshold value the designer has determined, experimentally.

The gain value calculating unit 138 produces change curves as shown in FIG. 4A or 4B by using the roll-off starting point and end point from the roll-off factor calculating unit 136, and calculates a gain value of each pixel for changing the gradient value of each pixel into an output gradient value by using the change curve produced thus, and forwards the same to the output gradient value determining unit 140.

The output gradient value determining unit 140 determines the output gradient value by receiving and compensating the required gradient value by using the gain value of each pixel from the gain value calculating unit 138. The output gradient value determining unit 140 calculates the gain value and the required gradient value of each pixel by using a multiplier and divider, to determine the output gradient value.

In this instance, in order to prevent flicker caused by sharp change or noise from taking place, as the gradient value from the output gradient value determining unit 140, the output gradient value determining unit 140 can averages the output gradient value of adjacent frames having weighted values given thereto by using a temporal filter for a plurality of frames and forwarded the same. As the temporal filter, an IIR (Infinite Impulse Response) filter can be used.

FIG. 4A illustrates a straight line change curve for mapping an actual output gradient on the required gradient before application of the adaptive roll-off in accordance with a preferred embodiment of the present invention. As shown in FIG. 4B, since the roll-off of the gradient is not required if the maximum required gradient value is smaller than the maximum threshold value of the expressible gradient, the straight line curve in FIG. 4B is the same with the straight line curve in FIG. 4A.

Opposite to this, as shown in FIG. 4C, if the maximum required gradient value is greater than the maximum threshold value of the expressible gradient, the roll-off end point is increased up to the maximum required gradient value, for moderating the gradient concentration. Moreover, the roll-off end point is determined to be a greater value of the average value of the required gradient values of one frame and the minimum threshold value of roll-off the designer determines, experimentally. Accordingly, as a slope of the straight line change curve in a roll-off section between the roll-off starting point and end point is reduced smaller than a slope of the straight line change curve of a low gradient portion, increasing a range of the expressible gradient value, the gradient concentration can be moderated.

In the meantime, at the time the maximum required gradient value is too great, if the roll-off end point is determined in conformity with the too great maximum required gradient value, the brightness of the image becomes too low. Therefore, as shown in FIG. 4D, by setting the roll-off maximum threshold value experimentally, the designer determines the roll-off end point to be the roll-off maximum threshold value if the maximum required gradient value is greater than the roll-off maximum threshold value.

Figure 5A:
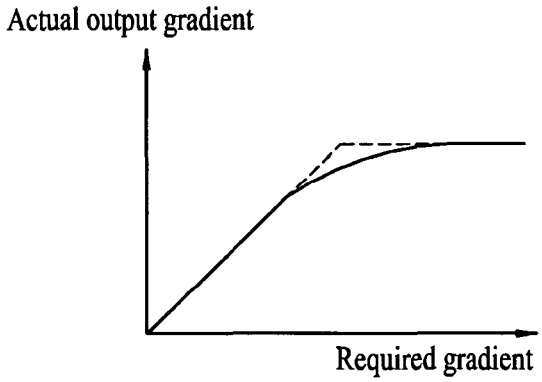
Figure 5B:
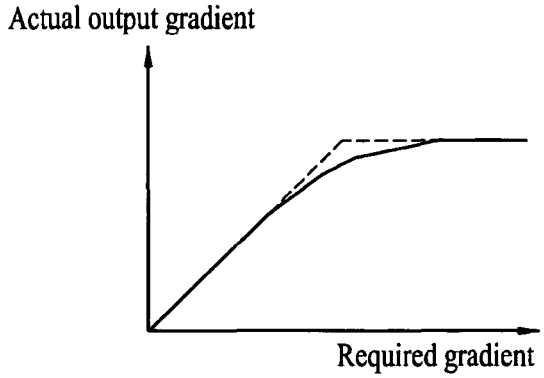

In the meantime, in the present invention, at the time the high gradient portion is rolled-off, the straight line curve can be used in the roll-off section as shown in FIGS. 4B~4D, a smoothly curved straight line curve can be used in the roll-off section as shown in FIG. 5A, or the change curve having a plurality of straight lines with slopes different from one another can be used in the roll-off section as shown in FIG. 5B.

Thus, by applying the roll-off adaptively to the image according to the maximum required gradient value of the image, the local dimming of the present invention can prevent the brightness from dropping due to roll-off by preventing application of the roll-off to the low gradient image, and can moderate the gradient concentration at the high gradient portion by increasing the range of the expressible gradient by applying the roll-off to the high gradient image which requires the roll-off.

Figure 6A:
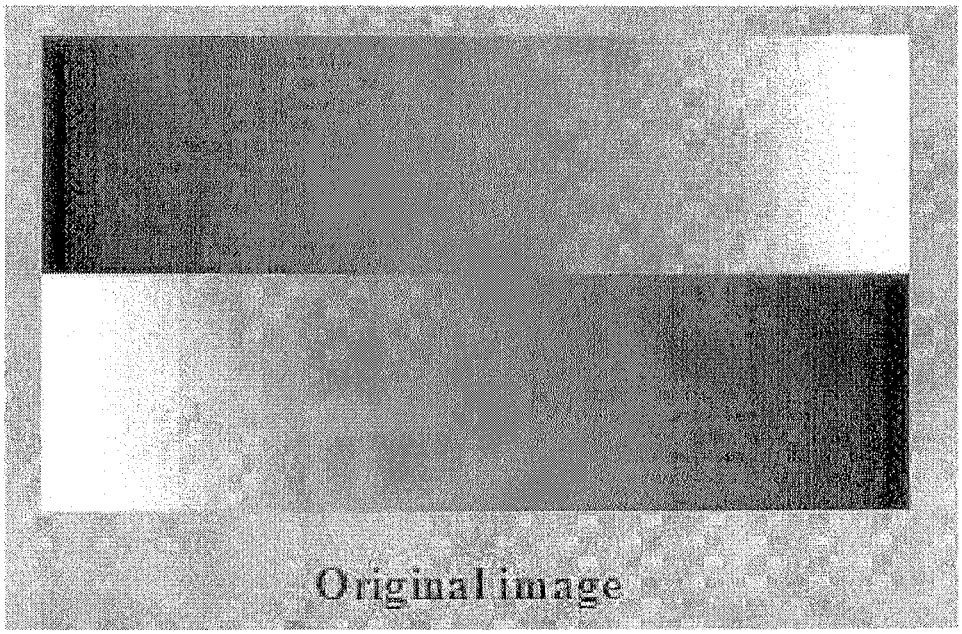
FIGS. 6A~6D illustrate comparative photographs showing images gradient concentration take place thereon after application of the related art roll-off and roll-off of the present invention thereto, respectively.
Figure 6B:
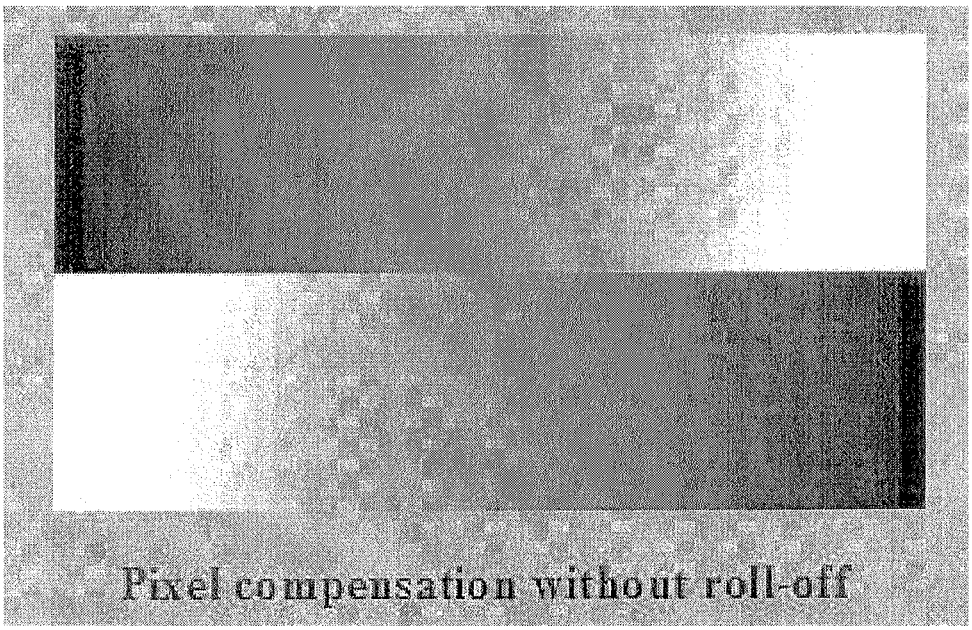
Figure 6C:
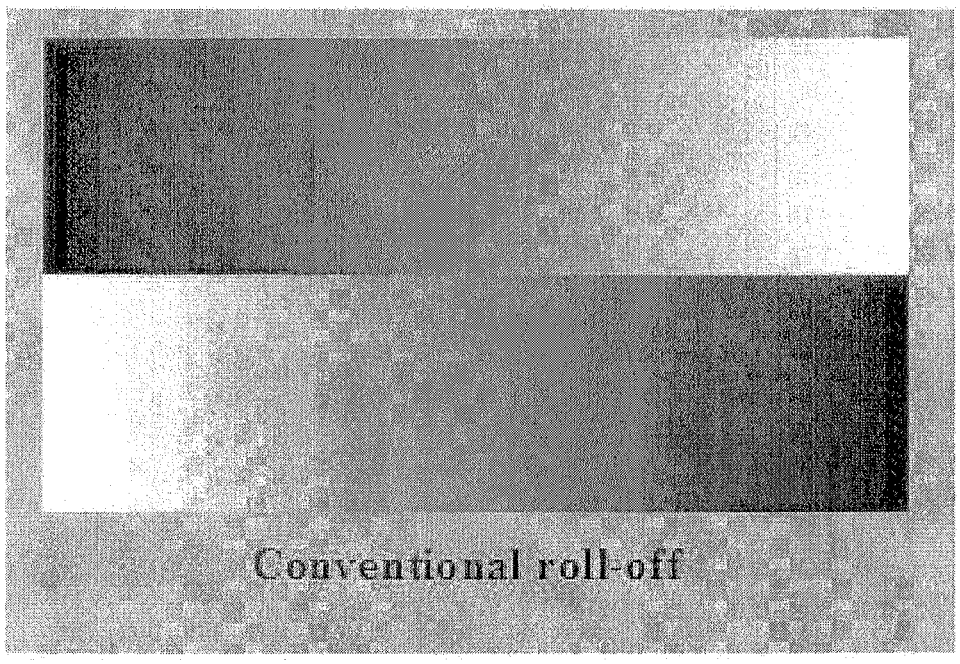
Figure 6D:
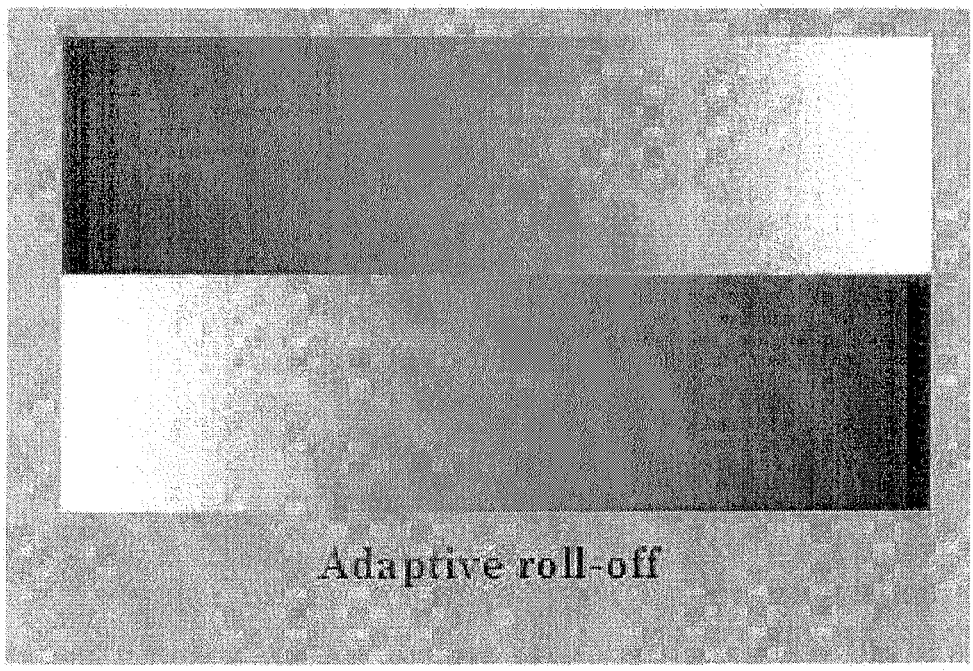

Referring to FIGS. 6A~6D, it can be known that the image having no roll-off applied thereto as shown in FIG. 6B shows no gradient concentration taken place at the high gradient portion in comparison to an original image shown in FIG. 6A. Opposite to this, it can be known that the image having the adaptive roll-off of the present invention applied thereto as shown in FIG. 6D shows the gradient concentration moderated at the high gradient portion similar to the image having the related art roll-off applied thereto as shown in FIG. 6C.

Figure 7A:
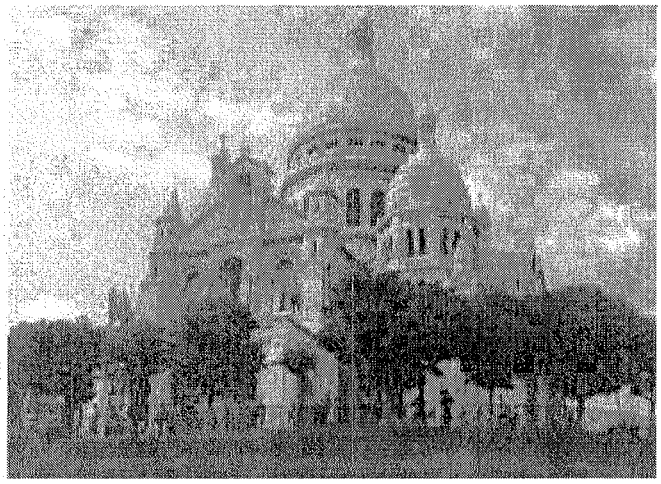
FIGS. 7A~7D illustrate comparative photographs showing images no gradient concentration take place thereon after application of the related art roll-off and roll-off of the present invention thereto, respectively.
Figure 7B:
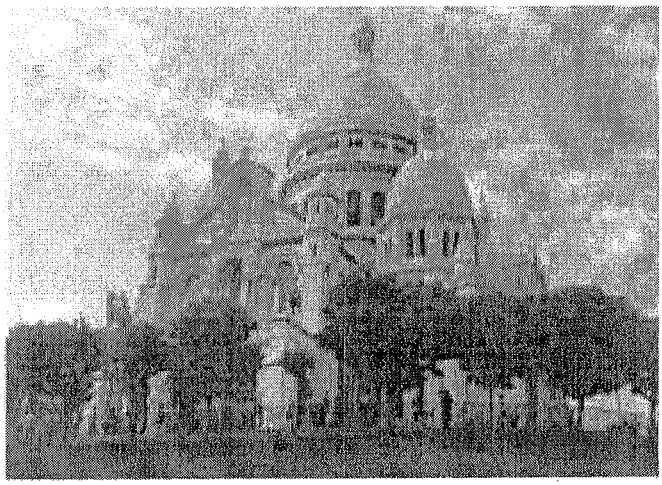
Figure 7C:
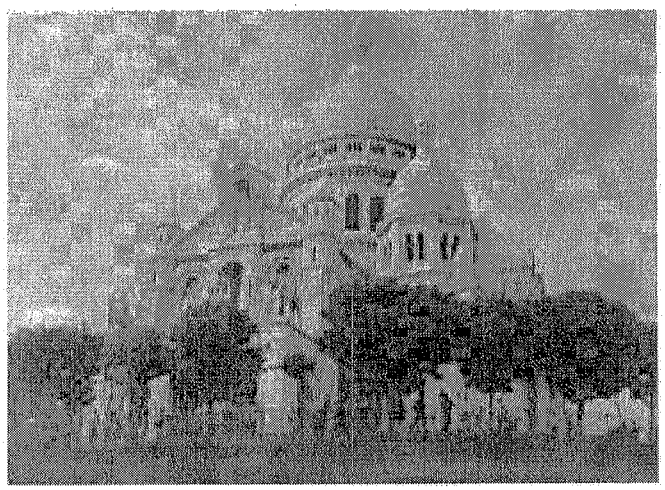
Figure 7D:
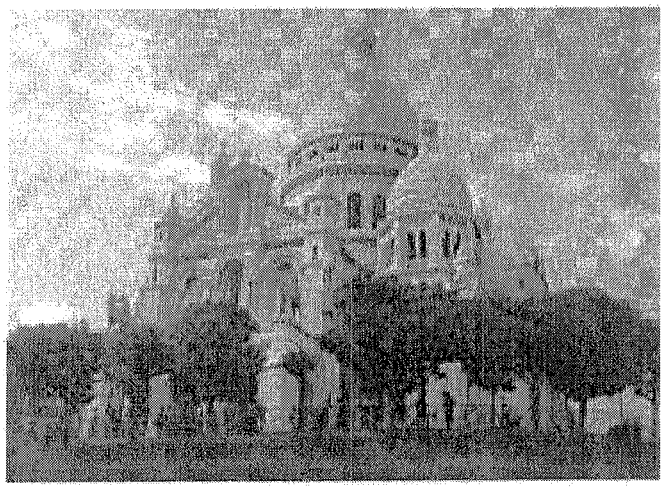

Referring to FIGS. 7A~7D, it can be known that the image having the related art roll-off applied thereto as shown in FIG. 7C shows the brightness dropped significantly compared to an original image shown in FIG. 7A. Opposite to this, it can be known that the image having the adaptive roll-off of the present invention applied thereto as shown in FIG. 7D shows no drop of the brightness similar to the image having no roll-off applied thereto as shown in FIG. 7B.

Figure 8:
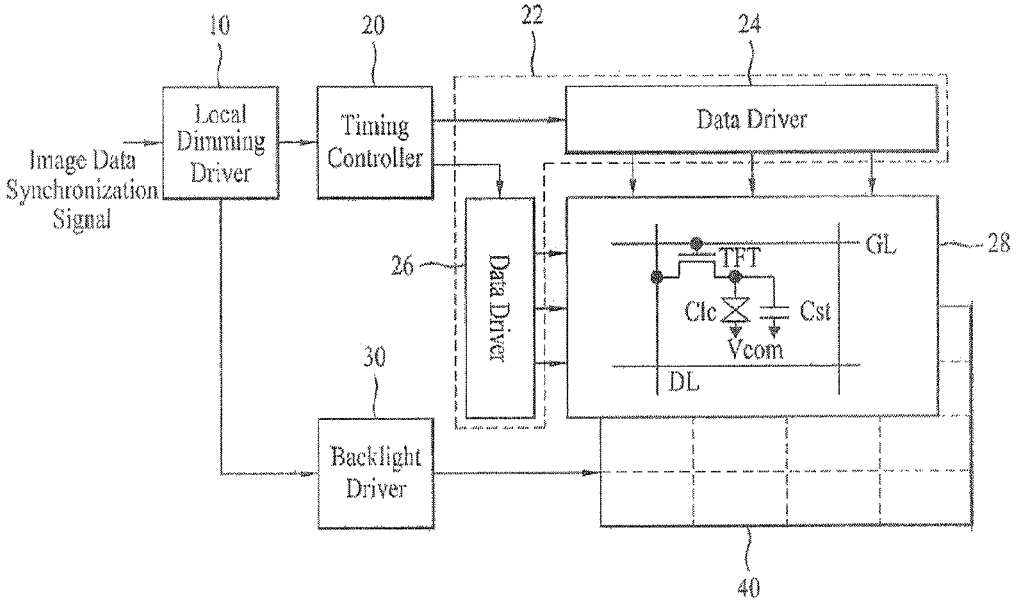
FIG. 8 illustrates a block diagram of a circuit showing a liquid crystal display device in accordance with a preferred embodiment of the present invention, schematically.

FIG. 8 illustrates a block diagram of a circuit showing a liquid crystal display device in accordance with a preferred embodiment of the present invention schematically having the local dimming driver 10 in FIG. 2 applied thereto.

Referring to FIG. 8, the liquid crystal display device includes a local dimming driver 10 for receiving and analyzing an image light emitting block by light emitting block to determine a local dimming value of each light emitting block, and applying adaptive roll-off to each of the local dimming values to compensate data, a timing controller 20 for supplying data from the local dimming driver 10 to a panel driver 22 and controlling operation timing of the panel driver 22, a backlight driver 30 for driving an LED backlight unit 40 block by block with reference to the local dimming value of each light emitting block from the local dimming driver 10, and a liquid crystal panel 28 driven by a data driver 24 and a gate driver 26 in the panel driver 22. In this instance, the local dimming driver 10 can be built-in the timing controller 20.

The local dimming driver 10 analyzes the data block by block by using a received image data and synchronizing signals, determines the local dimming value of each light emitting block according to a result of analysis, and forwards the same to the backlight driver 30. The local dimming driver 10 calculates a pixel compensating coefficient on the light quantity change by using the local dimming value of each light emitting block, and compensates the input data by using the pixel compensating coefficient, to produce a required gradient value. The local dimming driver 10 determines a gradient change curve in a gradient roll-off section by determining application of the gradient roll-off adaptively as well as a roll-off end point by using a maximum required gradient value in required gradient values for one frame, and determining a roll-off starting point by an average value of the required gradient values for one frame. The local dimming driver 10 calculates a gain value of each pixel by using the gradient change curve determined thus, compensates the received data (the gradient value) with the gain value of each pixel, and forwards the same.

The timing controller 20 receives and aligns the data from the local dimming driver 10 and forwards the same to the data driver 24 in the panel driver 22. And, the timing controller 20 generates a data control signal which controls an operation timing of the data driver 24, and a gate control signal which controls an operation timing of the gate driver 26 by using a plurality of synchronizing signals from the local dimming driver 10, such as a vertical synchronizing signal, a horizontal synchronizing signal, a data enable signal, and a dot clock signal, and forwards the data control signal and the gate control signal to the data driver 24 and the gate driver 26 respectively. In the meantime, the timing controller 20 can include an overdriving circuit (not shown) for adding an overshoot value or undershoot value to the data depending on a data difference between adjacent frames for modulating the data for improving a response speed of the liquid crystals, additionally.

The panel driver 22 includes the data driver 24 for driving the data line DL of the liquid crystal panel 28, and the gate driver 26 for driving the gate line GL of the liquid crystal panel 28.

The data driver 24 converts a digital image data from the timing controller 20 to an analog data signal (a pixel voltage signal) by using a gamma voltage and supplies the same to the data line DL of the liquid crystal panel 28 in response to the data control signal from the timing controller 20.

The gate driver 26 drives the gate lines GL in succession in response to the gate control signal from the timing controller 20.

The liquid crystal panel 28 displays the image with a pixel matrix which is an array of a plurality of pixels. Each pixel produces a desired color by a combination of red, green, and blue sub-pixels of which light transmissivity is controlled by varying an orientation of the liquid crystals in response to a brightness compensated data signal. Each sub-pixel has a thin film transistor TFT connected to the gate line GL and the data line DL, and a liquid crystal capacitor Clc and a storage capacitor Cst connected to the thin film transistor in parallel. The liquid crystal capacitor Clc has a difference voltage between the data signal supplied to the pixel electrode through the thin film transistor TFT and a common electrode Vcom supplied to a common electrode charged thereto, and controls the light transmissivity by driving the liquid crystals according to the charge voltage. The storage capacitor Cst sustains the voltage charged in the liquid crystal capacitor Clc, securely.

The backlight unit 40, either of a direct lighting type or an edge lighting type, is driven by the backlight driver 30 dividing the backlight unit 40 into a plurality of blocks in directing the light to the liquid crystal panel 28. A direct lighting type LED backlight unit has an LED array arranged throughout a display region to face the liquid crystal panel 28. The edge lighting type LED backlight unit has the LED array arranged to face at least two edges of a light guide plate which faces the liquid crystal panel 28 for converting the light from the LED array into a surface light source to be directed to the liquid crystal panel 28.

The backlight driver 30 drives the LED backlight 40 block by block according to the local dimming value of each block for adjusting brightness of the LED backlight 40 block by block. If the LED backlight 40 is driven divided into a plurality of ports, a plurality of backlight driver 30 can be provided for driving the plurality of ports, independently. The backlight driver 30 generates a PWM (Pulse Width Modulation) signal having a duty ratio matched to the local dimming value block by block, and supplies an LED driving signal matched to the PWM signal generated thus block by block, for driving the LED backlight 40 block by block. The backlight driver 30 drives the light emitting blocks in succession by using the local dimming value received therein in an order of connection to the blocks from the local dimming driver 10 for controlling backlight brightness block by block.

Eventually, the liquid crystal display device of the present invention displays the received image data with multiplication of the backlight brightness controlled block by block thus and the light transmissivity controlled by the compensated data at the liquid crystal panel 28.

As has been described, the method and device for driving local dimming in a liquid crystal display device of the present invention have the following advantages.

The data compensation by adaptive application of the roll-off according to a maximum required gradient of a received image prevents a low gradient image which does not require the roll-off from rolling-off enabling to prevent brightness drop caused by roll-off, and moderate the gradient concentration at a high gradient portion by applying the roll-off to the high gradient image which requires the roll-off to increase a expressible gradient value range.

It will be apparent to those skilled in the art that various modifications and variations can be made in the present invention without departing from the spirit or scope of the inventions. Thus, it is intended that the present invention covers the modifications and variations of this invention provided they come within the scope of the appended claims and their equivalents.

The invention claimed is:

1. A method for driving local dimming in a liquid crystal display device comprising:

determining a local dimming value of each light emitting block by analyzing a received image data block by block of a backlight unit;

calculating a pixel compensating coefficient on a light quantity change of each pixel by using the local dimming value of each light emitting block;

calculating a required gradient value by compensating the received image data by using the pixel compensating coefficient, and calculating maximum required gradient values for one frame and an average value of the maximum required gradient values for one frame;

determining a roll-off end point of a gradient roll-off section according to the maximum required gradient value, and determining a roll-off starting point of the gradient roll-off section according to the average of the maximum required gradient values;

setting a gradient change curve of the gradient roll-off section by using the roll-off starting point and end point, and producing a gain value of each pixel from the gradient change curve; and forwarding an output gradient value by correcting the required gradient value by using the gain value of each pixel.

2. The method as claimed in claim 1, wherein determining the roll-off end point and staring point includes the step of determining the roll-off end point and staring point have the same value and determining whether or not to apply the roll-off if the maximum required gradient value is smaller than the maximum threshold value of the output gradient value as a result of comparison of the maximum required gradient value to the maximum threshold value of an expressible output gradient value.

3. The method as claimed in claim 2, wherein the step of determining the roll-off end point and staring point further includes determining a smaller value of the maximum required gradient value and a roll-off maximum threshold value preset by a designer as the roll-off end point if the maximum required gradient value is greater than a maximum threshold value of the output gradient value.

4. The method as claimed in claim 2, wherein determining the roll-off end point and staring point further includes determining a greater value of the average value of the maximum required gradient values and a roll-off minimum threshold value preset by the designer as the roll-off starting point.

5. A device for driving local dimming in a liquid crystal display device comprising:

an image analyzing unit that detects a representative value of each light emitting block by analyzing a received image data block by block of a backlight unit;

a dimming value producing unit that determines and producing a local dimming value of each light emitting block according to the representative value of each block; and a data compensating unit that calculates a pixel compensating coefficient on a light quantity change of each pixel by using the local dimming value of each block, calculating a required gradient value by compensating the received image data by using the pixel compensating coefficient, calculating maximum required gradient values for one frame and an average value of the maximum required gradient values for one frame, determining a roll-off end point of a gradient roll-off section according to the maximum required gradient value, determining a roll-off starting point of the gradient roll-off section according to the average of the maximum required gradient values, producing a gain value of each pixel from a gradient change curve of the gradient roll-off section set by using the roll-off starting point and end point, and forwarding an output gradient value by correcting the required gradient value by using the gain value of each pixel.

6. The device as claimed in claim 5, wherein the data compensating unit includes;

a pixel compensating coefficient calculating unit that calculates a pixel compensating coefficient on a light quantity change of each pixel by using the local dimming value of each light emitting block, a required gradient value calculating unit that calculates a required gradient value by compensating the received image data by using the pixel compensating coefficient, and producing maximum required gradient values for one frame and an average value of the maximum required gradient values for one frame, a roll-off factor calculating unit that determines a roll-off end point of a gradient roll-off section according to the maximum required gradient value, and determining a roll-off starting point of the gradient roll-off section according to the average of the maximum required gradient values, a gain value calculating unit that calculates a gain value of each pixel from the gradient change curve of the gradient roll-off section set by using the roll-off starting point and end point, and producing, and an output gradient value determining unit forwarding an output gradient value by correcting the required gradient value by using the gain value of each pixel.

7. The device as claimed in claim 6, wherein the roll-off factor calculating unit determines the roll-off end point and staring point have the same and determining not to apply the roll-off if the maximum required gradient value is smaller than the maximum threshold value of the output gradient value as a result of comparison of the maximum required gradient value to the maximum threshold value of an expressible output gradient value.

8. The device as claimed in claim 6, wherein the roll-off factor calculating unit determines a smaller value of the maximum required gradient value and a roll-off maximum threshold value preset by a designer as the roll-off end point if the maximum required gradient value is greater than a maximum threshold value of the output gradient value.

9. The device as claimed in claim 6, wherein the roll-off factor calculating unit determines a greater value of the average value of the maximum required gradient values and a roll-off minimum threshold value preset by the designer as the roll-off starting point.

* * * * *